US006740342B1

(12) United States Patent
Hulst et al.

(10) Patent No.: US 6,740,342 B1
(45) Date of Patent: May 25, 2004

(54) SEPARATING AND RECOVERING COMPONENTS FROM PLANTS

(75) Inventors: Anne Coenraad Hulst, Gieten (NL); Jan Josef M. H. Ketelaars, Wageningen (NL); Johan Pieter M. Sanders, Groningen (NL)

(73) Assignee: Cooperatieve Verkoop-en Productievereniging van Aardappelmeel en derivaten Avebe B.A., Veendam (NL)

( * ) Notice: Subject to any disclaimer, the term of this patent is extended or adjusted under 35 U.S.C. 154(b) by 0 days.

(21) Appl. No.: 09/868,401

(22) PCT Filed: Dec. 24, 1999

(86) PCT No.: PCT/NL99/00805

§ 371 (c)(1),
(2), (4) Date: Sep. 17, 2001

(87) PCT Pub. No.: WO00/40788

PCT Pub. Date: Jul. 13, 2000

(30) Foreign Application Priority Data

Jan. 6, 1999 (NL) ..... 1010976

(51) Int. Cl.[7] ..... A61K 35/78; A23P 1/00

(52) U.S. Cl. ..... 424/725; 424/773; 426/481; 426/489; 426/495

(58) Field of Search ..... 424/725, 773; 426/481, 489, 495

(56) References Cited

U.S. PATENT DOCUMENTS

| | | | | |
|---|---|---|---|---|
| 3,890,888 | A | * | 6/1975 | Verberne |
| 3,948,677 | A | * | 4/1976 | Huster et al. |
| 4,203,845 | A | * | 5/1980 | Bouwer |
| 4,332,125 | A | * | 6/1982 | Holdren |
| 4,481,355 | A | | 11/1984 | Jaskowski |
| 4,536,288 | A | * | 8/1985 | Hultsch |
| 5,464,160 | A | | 11/1995 | McDonald et al. |
| 5,820,916 | A | * | 10/1998 | Sagliano et al. |

FOREIGN PATENT DOCUMENTS

| | | | |
|---|---|---|---|
| BE | 1006318 | * | 7/1994 |
| DE | 77408 | * | 1/1970 |
| GB | 658129 | | 10/1951 |
| GB | 2103635 | * | 2/1983 |
| SU | 424881 | * | 10/1974 |
| WO | WO/9713402 | * | 4/1997 |
| WO | WO 00/40788 | | 7/2000 |

* cited by examiner

*Primary Examiner*—Christopher R. Tate
(74) *Attorney, Agent, or Firm*—Hoffmann & Baron, LLP

(57) ABSTRACT

A method for separating cytosolic and parenchyma components from vegetable material comprising fiberizing the vegetable material by means of a pulp or paper mill refiner is disclosed.

9 Claims, 7 Drawing Sheets

SEPARATING AND RECOVERING COMPONENTS FROM PLANTS

BACKGROUND OF THE INVENTION

The invention relates to the separation and recovery of components from plants.

Plants, like most organisms, are made up of cells. A plant cell consists of a lipid membrane with a generally aqueous content, the cytosol, which contains the various cell organelles (likewise surrounded by lipid membranes), such as nucleus, mitochondria, endoplasmic reticulum and chloroplasts, and the cytoskeleton, made up of microfilaments and microtubules, which gives the cell an inner structure. Also present in the plant cell are vacuoles which play an important role in keeping the plant cell under tension; the vacuoles maintain the turgor of the cell.

The constituent components of a plant cell can be roughly distinguished into water, which accounts for the greater part by far of a living cell, components such as salts, (precursors of) lipids, carbohydrates, amino acids and nucleotides, macromolecules such as starches, proteins and nucleic acid and a multiplicity of other molecules, including vitamins and pigments such as chlorophyll, carotene and xanthophyll.

A plant cell is generally surrounded by a cell wall which provides firmness and structure to the plant tissue. The cell wall is mainly built up from (hemi)cellulose and other carbohydrate polymers, which have aggregated to fiber bundles. Woody plants further contain an ample amount of lignin, a polymer made up of phenols and other aromatic monomers.

Plant tissue is made up of plant cells, all of which, when living, basically satisfy the above description. An important distinction can be made between relatively firm tissues which comprise virtually no chloroplast or other plastid containing cells, and the relatively soft tissues which generally do. Tissues which generally comprise no chloroplast containing cells are, for instance, the epidermis or skin tissue of a plant, the collenchyma and sclerenchyma or stroma of a plant and the vascular fiber bundles or the vascular tissue, comprising the important transport vessels (wood vessels and sieve tubes) in the plant. When a part of a plant is strongly lignified, in general, over time, the majority of the cells in the lignified part die off and only residues of the cell content are left. In particular the cytosol and the organelles present therein are lost, but the vascular fiber bundles, skin and stromas generally give the plant form and structure and generally remain present when the plant is dead. Characteristically, these relatively firm tissues (in particular vascular bundles, sclerenchyma and epidermis) comprise no to virtually no chloroplast containing cells, while an important part (at least in the aerial leaf and stem parts of the plant) of the relatively soft tissues, also called chlorenchyma, is made up chiefly of only chloroplast-containing parenchymal cells; indeed, this is where photosynthesis occurs. Non chloroplast containing parenchyma (such as can be found, for instance, in fruits, seeds, roots and tubers of the plant, but also in the underground leaf and/or stem parts) is mainly involved in the storage of nutrients, water or gases. Such storage occurs in particular in cell organelles related to the chloroplasts, generally referred to as (pro)plastids, as in amyloplasts (storage and production of carbohydrates), elaioplasts (lipids) and chromoplasts (pigments).

Genetic manipulation or modification of plants is the alteration of transferable properties or characteristics of a plant through modern recombinant or biotechnological techniques. The technique of genetic manipulation was developed in plants at an experimental level in the mid-eighties. In the early nineties, this led to the first ready-for-trade products. At present, the technique is mainly applied to bacteria, fungi and plants. In animals too, however, there are possibilities. The techniques in animals at this junction are not yet optimal or non-profitable, and entail problems in the field of ethics where higher developed animals are concerned.

Transferable properties are more-or-less simple properties, encoded by a gene for a particular locus. A genetically modified plant (or transgenic plant) is a living organism to which a gene with particular properties, which has been identified in a donor organism, is transferred through genetic manipulation techniques (DNA recombination). It is also possible to genetically modify a plant, such that it can no longer activate or express a particular gene traditionally present in that plant: the gene in question is then eliminated. Due to the transferred or eliminated gene, the transgenic or modified plant acquires a new property or other characteristic, in their turn transferable to the offspring. The transfer or elimination of genes can be carried out by using, for instance, a bacterium such as *Agrobacterium tumefaciens*, which is capable of transferring genetic material to a plant cell by means of plasmids. The genes are subsequently incorporated into the genome of the infected cell. Other ways of modification can be chosen, such as bombarding a plant cell with balls enveloped with DNA fragments which include the gene to be transferred.

The use of modern biotechnology in agriculture offers new possibilities whereby, at first sight, certain yields are guaranteed and fewer phytosanitary products need to be deployed in pest and disease control, and also qualitatively high-grade products are obtained. Estimates from 1998 show that transgenic plants are grown worldwide on an area of 30 million hectares (compared to 14 million hectares in 1997). This is done mainly in the United States (88%), South America (cotton in Argentina) (6%) and Japan (6%). Figures on the area in China on which transgenic crops are grown are not known, but the percentage involved is probably considerable.

In addition to the currently marketed varieties improved by genetic manipulation—some twelve food and non-food crops—there is a rapid and gigantic progress to be expected in research in this field, even though the majority of the applications are now still in the experimental stage. Possible improvements are of major importance, in particular in the cultivation of food crops. In addition, there is the expected development of genetically modified plants for products in the non-food sector, which are a very interesting source of diversification for agriculture.

In principle, two types of genetic modifications are conceivable. A first type concerns the introduction of new properties or characteristics which promote or are helpful in the growth or cultivation of the crop in question. To be considered here are, for instance, the introduction of drought or cold resistance, so that the crop can also be grown in regions other than those where it originally thrived. The introduction of new properties or characteristics which promote or are helpful in the growth or cultivation of the crop in question also encompasses the introduction of resistance to or tolerance of herbicides, so that weed control with the herbicide in question can be carried out around the crop without the modified or recombinant crop thereby sustaining appreciable damage, or the introduction of resistance to diseases or pests.

A second type concerns the introduction or elimination of genes which enables the crop in question to yield a potentially higher-grade (recombinant) end product. To be considered here are, for instance, taste improvement or better keeping properties of products. However, a more important application is to increase or enrich the plant with valuable components or content substances. Increasing the vitamin content of a plant through genetic modification; increasing and/or enriching the protein or amino acid content, whereby the plant preferentially produces high-grade proteins or amino acids through genetic modification; improving the balance between saturated and unsaturated fatty acids through genetic modification are all examples of envisaged possibilities of genetic modification in plants.

Also envisaged are new production possibilities for highly specific compositions. In particular the production of vaccines (based on plants which express recombinant proteins or peptides) of antibiotics (based on plants which are equipped with recombinant enzymes or enzyme systems capable of producing these antibiotics), and of other factors important for human or veterinary, medicine (hemoglobin, insulin, coagulation factors, growth hormone, human or animal (digestive) enzymes, and so forth) are applications of the introduction or elimination of genes enabling the crop in question to yield a potentially higher-grade (recombinant) end product.

The current applications of introducing new properties or characteristics which promote or are helpful in the growth or cultivation of the crop in question, such as in the field of herbicide tolerance, have progressed most. They are promising for agricultural production, production cost management and with regard to the environmental consequences of agricultural activity. The resistance of plants to diseases as obtained through transgenesis offers clear advantages for the growth or cultivation of the plant in question: in particular, there are very few conventional means, and in some cases even none, for controlling bacteria and viruses. If the resistance of the plant is inherent, treatments can be omitted in nearly all cases, and the effect on the yield is then significantly higher than upon treatment.

However, in the case of introducing or eliminating genes, as a result of which the crop in question can yield a potentially higher-grade (recombinant) end product, there are also problems of a different order to be overcome. Essential questions regarding the recoverability of the desired product are, for instance: how is the high-grade product to be recovered; how do I separate the high-grade (recombinant) component from the other vegetable material; must the component to be recovered be present in certain easy to harvest parts of the plant (seeds, fruits, tubers, etc.) (which dictates strict requirements regarding the nature of the genetic modification: not only is it necessary to provide a modified gene that codes for the product in question, but also this gene needs to be expressed in the right place) or must the component in question be recovered from all parts of the plant?

The existing recovery technologies have no clear answers, and this holds in particular for protein products, for relatively low-grade products, for products which are present in the plant in a relatively low concentration, and for products which are proportionally distributed throughout the plant. It has long been known to recover various components from vegetable raw materials for further use in, for instance, food for human or feed for animal consumption through mechanical methods. Often, plants are merely comminuted or chopped to make them suitable for consumption, an example being the chopping of corn for fodder. It is clear, however, that chopping does not contribute to a better recovery of a recombinant component which is to be obtained in relative purity.

In particular the components present in the cytosol of the plant cell are outstandingly suitable for human food or animal fodder, since these can be building materials for corresponding components which are found in animal cells. For that reason, in particular specific parts of a plant, such as seeds, tubers, roots or fruits which are specifically rich in, for instance, juice, sugars, protein, oil or starch are sometimes subjected to further-reaching recovery methods, such as pressing or grinding. Examples are the pressing of oil from olives or oil-containing seeds, the recovery of protein from soybeans, or the grinding of potatoes or grain kernels to form flour. Another known example is the squeezing of juice from fruits such as grapes, for direct consumption or for further processing. In the case of grape juice, this concerns mainly the water, the sugars and the color and flavor, and the further conversion to wine.

An example of a recovery of a vegetable raw material where no pressing method is used, is the recovery of sugar from, for instance, sugar beet. Beets are generally cut up into narrow strips (sometimes referred to as chips) whereafter the chips are flushed with hot water in a diffusion tower. During this diffusion process, the sugar diffuses from the beet cells. The sugar is released relatively readily from cells already damaged, but needs to be released from the intact beet cell—present, of course, in much greater numbers—through osmosis and/or dialysis. This osmosis and dialysis can only be done profitably when the temperature is accurately controlled throughout the process, for instance at 72° C., and using sufficiently large amounts of water. It can be stated that per ton of sugar beet, at least 1100 liters of water are needed. Through a countercurrent principle, the sugar-rich water is separated from the wet chips (now called pulp). The wet pulp is dried, and the sugar water (optionally after filtration, carbonation and other pretreatments) is evaporated. Drying the pulp and evaporating the sugar-rich water to thick juice, also called serum, requires much energy.

Traditionally, mechanical processing has also been applied to feed crops, such as grass, lucerne and other fresh and green harvested plants which, often as virtually whole plant, and in particular the leaf and/or stem parts and in most cases not including the roots, are used for recovering, for instance, (animal) food components. Such vegetable raw materials are generally recovered through pressing of (preferably chopped or otherwise comminuted) leaf and/or stem material, whereby a part of the vegetable material is obtained as press juice, while the residual and pressed material is known as press cake. These techniques are also available when the material would originate from genetically modified plants.

However, the pressure forces exerted by pressing generally result in only partial opening up (snapping or bursting) of plant cells in the material, so that only a portion of the aqueous but food component-rich cytosol, possibly with residues of the organelles and the lipid membrane surrounding the cell, is liberated from the cell as press juice. The efficiency of such a method is therefore low. Press juice is generally treated further, for instance through screening, whereafter, for instance, the protein in the juice is recovered by means of coagulation through, for instance, acid and/or heat treatment. Press juice may also be further processed, through (ultra or membrane) filtration, drying, fermentation or other methods known to the skilled person. Protein-rich or otherwise high-grade nutrients for human and animal consumption, but also pigments such as carotene (provitamin A), can be recovered from cytosol in this way only with low efficiency.

The resultant, relatively dry press cake is generally regarded as less rich in food: it contains relatively intact fiber bundles composed of (not directly) digestible cellulose fibers, adherent press juice and residual plant cells which have not been accessed under the influence of the pressing. Especially these residual plant cells with unrecovered cytosol still give fodder value to the press cake, which is generally dried and, pelleted or otherwise, is used as relatively low-grade (roughage) component in fodders, in particular for ruminants.

For mechanically accessing, for instance, grasses, traditionally a method is used which is based on the disintegration of the vegetable raw material by means of hammer mills followed by squeezing the disintegrated raw material (here designated as pulp) using screw presses or belt presses. The pulp is thereby separated into a press cake fraction and a press juice fraction. The juice fraction is regarded as the fraction in which the industrially recoverable content substances from the plant material are contained. Hammer mills typically consist of a rotor on which fixed of freely movable elements are disposed which upon rotation of the rotor are brought into contact with the vegetable raw material and disintegrate it through force of impact. The disintegratory effect of hammer mills is relatively great when the vegetable material has a good turgor, i.e. when the plant cells are under tension. In that case, the force of impact causes the tissue to snap and causes the cell content constituents to be liberated with the tissue fluid. If turgor is low, beating the plant material will cause it to be compressed. The tissue then remains more or less intact and the result is that the cell content becomes available to a much lesser extent. This has major consequences for the recoverability of particularly those cell content constituents that are present in the vegetable biomass only partly in dissolved form and for another part in the form of solid, undissolved matter. This holds true inter alia for vegetable proteins, but also for lipids and pigments, and it will be understood that this will not be different for recombinant products. Also known (for instance from U.S. Pat. No. 5,464,160) are hammer mills where relatively dry material is separated into two fractions, this while neglecting the so valuable juice stream with protein-rich cytosol.

In the above-described methods of pressing vegetable material, it is generally of importance that the material be processed while still as fresh as possible, shortly after harvesting. Only then are the plant cells sufficiently under tension to be able to burst or snap under pressure so that the cytosol is liberated. When, after harvesting, already some time has elapsed before the plant parts are pressed, they are already dried out to some extent by then, the plant cells present have lost a large part of the necessary turgor and are too slack to be able to snap or burst under pressure. Accordingly, in non-fresh material, the recovery of press juice will proceed with even less efficiency. The same holds for material stemming from plants which, even before they were harvested, already lost a large part of the turgor in their plant cells through drying out and/or maturation. In general, such plants are not (completely) green anymore but acquire brown or yellow aspects. Lignified plant parts are altogether ineligible for the above methods, since most cells have died off in them, or in any case they contain only a very minor cytosol fraction and hence do not contribute to the recovery of high-grade food.

In general, plant material is separated into a (press) cake fraction (gulp) and a (press) juice fraction (serum). Characteristic of this method is the only partial extraction (along with the press juice) of the cell content constituents (vacuole content and cytoplasm with cell organelles present therein, such as chloroplasts and cell nuclei); the cell walls are substantially completely left behind in the press cake together with the remainder of the cell content. Contained in the press cake are all tissues which are also contained in the raw material, and in addition also a part of the cell content. The color of the fresh press cake is predominantly green or yellow in that the chloroplasts having therein the chlorophyll (leaf green) present, have only been partly removed with the press juice. The plant material has only partly disintegrated down to tissue level; this means that still recognizable fragments of leaves and stems are present in addition to individual tissues such as isolated vascular bundles.

The press juice consists substantially of the aqueous content of cells: the vacuole content and the cytoplasm having therein cell organelles such as chloroplasts in intact or disintegrated form; cell wall constituents are substantially absent in that they remain behind in the press cake.

Consequently, the recoverability of protein and other partly soluble substances in the traditional method of fractionation is highly susceptible to variations in the nature of the vegetable biomass, in particular the presence of turgor, which is typically reflected in differences in dry matter content.

The traditional method of fractionation has as a consequence that upon squeezing the pulp, only a part of the cell content constituents end up in the juice stream and another part remains behind in the press cake. Accordingly, the press cake still contains, in addition to the greater part of the cell walls, a part of the cell content constituents and, by virtue of that, is used as fodder.

The existing pressing methods for separating high-grade from low-grade components from vegetable material are thus relatively strongly dependent on the turgor of the cells present in the vegetable material, which limits the application of these methods to their application to relatively fresh and green material. The existing methods are therefore not very suitable for recovering high-grade components from genetically modified plants with efficiency. Often, the resultant press cake, also when fresh and/or green material is used, still contains large amounts of unaccessed plant cells with high-grade cytosol in them, while only a low price can be obtained for press cake since it is in fact suitable only as a relatively low-grade component of fodder. The existing classic methods could also, in principle, be applicable to genetically modified plants which have specifically been modified such that precisely their parts such as seeds, tubers, roots or fruits are rich in, for instance, the desired recombinant proteins, peptides, amino acids, oils and carbohydrates. However, traditional pressing methods, such as known, for instance, in grasses, are incapable of complete separation of juice and fiber fractions. A diffusion process as described in relation to the processing of sugar beet also has major disadvantages. It requires so much water and energy that the recovery of the desired raw material, if possible at all, would become very expensive. In particular now that genetically modified sugar beet and other tuberous and/or root plants will increasingly often be grown as a crop, there is a need for better recovery methods, which can then be used as well in unmodified crops. Also, specific localization of the component to be recovered requires more than the modification of a gene alone. In most cases, it will then be necessary to modify the plant, such that besides producing the desired product, the plant also has the modified systems to store the desired products in those specific parts. The molecular-biological knowledge of the systems involved in the storage is at this point generally insufficient for manipulation of the storage of the product as well, such that the desired result is achieved. Tissue-specific expression of recombinant genes is still in its infancy. In general, it may be expected that the desired product will also, and chiefly so, be found in the leaf and/or stem parts of the modified plant.

For recovering high-grade components from genetically modified and unmodified plants, such as, for instance, from leaf and/or stem parts, roots or tubers, there is a need for better methods which can access the plant cell with a higher efficiency than do the existing methods, can make the cytosol fraction more available for recovery, and affords better marketing possibilities for the fiber-containing residual material. The object of the invention is to provide for this need.

SUMMARY OF THE INVENTION

The invention provides a method for separation of components from material of a plant, characterized in that the material is at the least partly fiberized and subsequently is separated into a fiber fraction and a juice stream, such that the fiber fraction chiefly comprises relatively firm tissues such as epidermis, sclerenchyma and vascular bundles, and the juice stream chiefly contains soft tissues such as parenchyma and cytosol. In a preferred embodiment, the invention provides a method for separating a juice stream comprising in particular chloroplasts, however, also that parenchyma that particularly comprises other plastids, such as amyloplasts, elaioplasts and chromoplasts is easy to separate from the fiber fraction. The invention provides a new method of fractionation, which consists of at least two steps: a first step in which the vegetable material is fiberized through the action of shear forces and a second step in which the fiber fraction is separated from the rest.

The method according to the invention is applicable to all fiber containing vegetable materials, originating both from cultivated plants (crop plants) and from wild plants, as well as to crossing products.

DETAILED DESCRIPTION OF THE INVENTION

A method according to the invention is applicable to vegetable material, which may or may not be genetically modified, chiefly comprising leaf and/or stem parts, such as vegetable biomass originating from cultivated grassland, feed crops such as forage grasses and maize, lucerne, clover, and other papilionaceous plants, fiber crops such as flax and hemp, and the tops of crops normally grown solely for their seeds, fruits or tubers, such as grains, beets, peas, beans, potatoes, carrots, cassava, sweet potato. The method according to the invention is also applicable to the processing of conventional seeds, fruits or tubers, such as grains, sugar beet, Jerusalem artichoke, beets, peas, beans, potatoes, carrots, cassava, sweet potato, and to genetically modified plants which have specifically been modified, such that precisely their parts such as seeds, tubers, roots or fruits are rich in, for instance, the desired recombinant proteins, peptides, amino acids, oils and carbohydrates.

Fractionation of vegetable biomass means the separation into a number of fractions. By fractionating biomass, new product streams are formed with other application possibilities than the raw material itself. Consequently, these new product streams jointly often represent more value than the original biomass. The invention provides a new technique which is based on fiberization and subsequent defibration of vegetable biomass.

In a preferred embodiment, the invention provides a method for separation of components from vegetable material, characterized in that the material is at the least partly mechanically fiberized and subsequently is separated into a fiber fraction and a juice stream, with the fiber fraction (see, for instance, FIGS. 1 and 2, also for a comparison with a traditional method) principally comprising relatively firm tissues such as epidermis, sclerenchyma and vascular bundles, and the juice stream (see, for instance, FIGS. 6 and 7, also for a comparison with a traditional method) principally containing soft tissues such as parenchyma and cytosol. The mechanical fiberization is effected, for instance, through treatment of the material in a blender. Preferably, certainly when application on an industrial scale is desired, the fiberization is done, according to the invention, with an apparatus such as a (pressure) refiner, with grinding disks, such as employed in the pulp and paper industry, or in an apparatus of equivalent action by which the vegetable material can be fiberized to enable separation into a fiber fraction which principally comprises relatively firm tissues such as epidermis, sclerenchyma and vascular bundles, and the juice stream principally comprising soft tissues such as parenchyma and cytosol. In fiberization, the vascular tissue with the sclerenchyma and the epidermis jointly the fiber fraction) is mechanically dissociated from the other, substantially parenchymal tissue. This parenchymal tissue is at the same time accessed and the cell content constituents therefrom (cytosol and parenchyma) thereby become available substantially completely. Fiberization can be done using refiners such as they are in use in the pulp and paper industry for fiberizing wood and wood pulp. Refining, in this case fiberization, typically occurs with addition of moisture to the plant material. The result is then a slurry of fiberized material from which the fibers can be removed. The fiber fraction (fiber stream) which is thus recovered, is suitable, through its nature and composition, inter alia for the following applications: as raw material for paper and cardboard (solid cardboard, folding cardboard and form cardboard), as raw material for the production of fiberboard materials (softboard, hardboard, chipboard, MDF, HDF and MDF/FHDF form parts) and composites, as raw material for moisture absorbing materials, such as diapers, sanitary napkins, and so forth, as raw material for the preparation of growth media (potting compost and substrates), mulches (as protection against erosion, and as weed and disease suppressant), as soil improver or as fuel.

In defibration, the liberated fiber is separated, for instance through screening, from the other plant constituents. Through washing and screening, the fiber can be further purified and as many non-fiber constituents as possible can still be recovered with the washing water. The defibered slurry then consists of a mixture of added water, tissue fluid, cell content constituents and finely dispersed cell walls coming from the parenchymal tissue. From the defibered slurry or juice stream, content substances can be recovered in a more or less pure form, such as: (recombinant) proteins, peptides and (high-grade) amino acids, vaccines, antibiotics or other factors important in medicine, enzymes, pigments, lipids, fatty acids, starches, soluble sugars and (cell wall) carbohydrates for use in livestock feeding, human nourishment, or as substrate for fermentations, or, through concentration, fodder or food products can be made with a high nutritive value as a result of the presence of high-grade proteins, peptides, amino acids or other components and/or as a result of the removal of the non-digestible or poorly digestible fiber fraction.

The defibered slurry can be further fractionated in subsequent steps. One possibility is, for instance, the separation of all solid parts through centrifugation, which may or may not be preceded by a coagulation step through heating, acidification or otherwise. Another possibility is to convert the parenchymal cell walls into soluble sugars using cell wall splitting enzymes (pectinases, cellulases, etc.) and thus adding them to the fraction of dissolved substance in the defibered slurr.

Characteristic of the method is envisaged by the invention is the split at tissue level into a fiber fraction which contains the relatively firm tissues (vascular bundles, sclerenchyma and epidermis) and a defibered fraction which contains the relatively soft tissues (parenchyma) with their content. Briefly summarized, the difference between the traditional and novel method is the extraction of tissue fluid (traditional) versus tissue fractionation (new method). The new method provides for the recovery of components from plants with a high efficiency, whereas in a traditional method large amounts, of high-grade component remain behind in, for instance, the pressed material, or a very high energy demand is entailed.

Eligible for processing according to a method provided by the invention are, in particular, also genetically modified crop plants, where the plant has been so altered as to preferentially express one or more components in, for instance, the cytosol or in a cell organelle. Also in genetically modified plants (and in particular in those where the accumulation of a (recombinant) high-grade component as obtained by the genetic manipulation is spread through several parts of the plant), proper accessing of the plant cell and its content is of great importance, so that a product obtained through modern biotechnological manipulation of such a cultivation crop can be recovered with the highest possible efficiency. The application of a method according to the invention for instance makes it possible to also utilize with a high efficiency genetically modified plants where the component which, through the genetic modification, has increased in quantity or is present de nouo, such as a vaccine, an antibiotic or another factor which is important in (veterinary) medicine, or (recombinant) high-grade proteins, peptides or amino acids, is proportionally present in the parenchyma of all leaf, stem and/or root or tuber parts, owing to the virtually complete recovery of the plastids, such as chloroplasts, amyloplasts, elaioplasts and chromoplasts, present in the parenchyma, readily separable from the fiber fraction by the use of a method according to the invention.

The invention also provides for the separation of components from root and/or tuber parts of crops which may or may not be genetically modified, such as sugar beet. In an embodiment of a method according to the invention, washed sugar beets are metered in pre-chopped or pre-cut form into a refiner. During this process step, the tuberous tissue is fiberized into a pulp. After the fiberization step, the fiber fraction is separated from the juice stream, for instance through screening, filtration or centrifugation, and the solid fraction is optionally washed with water to recover the components which can still be dissolved therein. The liquid fraction or juice stream can be further processed after centrifugation, to recover the sugars in the manner conventional in the sugar industry (carbonation, concentration, crystallization, centrifugation, etc.). By the use of the method according to the invention, the conventional diffusion step is not necessary anymore. Not 1100 liters of water are recovered, but an already highly concentrated juice stream is the result. Besides a direct saving of cost as a result of the elimination of the diffusion step, the concentration of the sugar in the serum or juice stream will be higher than that in the stream of the diffusion step. Moreover, the elimination of the diffusion step will mean a saving of the total amount of water required, with an inherent saving of evaporation and drying costs. By following a method according to the invention, the sugar loss (normally about 2%) will be greatly reduced in that the total amount of sugar present in the beet remains behind in the serum. Also, owing to the fiberization, the fiber fraction of the sugar beet is better digestible than the conventional pulp, when used as ingredient of fodders. Also for genetically modified beets, such as, for instance, beets having an increased fructose-oligosaccharide content or an increased amino acid synthesis, the processing is preferably done as provided by the invention.

The invention also provides an apparatus for practicing a method according to the invention. Such an apparatus is characterized by means suitable for the fiberization according to the invention, whereby the relatively firm vascular tissue with, for instance, the sclerenchyma and the epidermis jointly the fiber fraction) is mechanically dissociated from the other, substantially parenchymal tissue. This parenchymal tissue is at the same time accessed and the cell content constituents therefrom (cytosol and parenchyma) thereby become available substantially completely. 'Fiberization' is herein understood to mean that the plant material is exposed to such forces that the relatively firm tissues are dissociated virtually completely from the relatively soft tissues. As a resultant of the forces which effect this fiberization, the great majority, if not virtually all, of the plant cells will be accessed, so that the cytosol is liberated. This cytosol, as a juice stream generally also including residues of the organelles and the cell surrounding lipid membrane and parenchymal cell walls, can be relatively simply separated from the fiber component through screening or through other separation means known to one skilled in the art.

A first advantage of the invention is that the efficiency of the method is not dependent on the turgor of the plant cells present in the material, so that the plant cells can be accessed with greater efficiency than is conventional in the above-described pressing methods.

A second advantage of the invention is that the invention provides two product streams which as such are very pure. A first one, the fiber fraction, contains principally cellulose and hemicellulose, principally consisting of the elements C, H and O (which in itself yields advantages for a clean combustion); a second one contains all valuable and complex content substances and, for instance, the recombinant component(s) which are to be found in the parenchyma and cytosol, and which can be further separated relatively simply.

The two product streams can be separated from each other by, for instance, screening. Other separation methods are also conceivable, for instance centrifugation, processing by (hydro)cyclone and centriscreening, and decanting or sedimentation, or combinations of these methods. In defibration, the liberated fiber is separated from the other plant constituents through, for instance, screening. By washing and screening, the fiber can be further purified and as many non-fiber constituents as possible can still be recovered with the washing water. The defibered slurry then consists of a mixture of added water, tissue fluid, cell content constituents and finely dispersed cell walls coming from the parenchymal tissue.

A first product stream as contemplated by the invention is a (generally high-grade) juice stream consisting of an aqueous solution/suspension of virtually all high-grade (recombinant) components or nutrients from the vegetable material (such as sugars, proteins, lipids, pigments, and the like). Through removal of the (nutritionally low-grade) cell wall fiber components, there is formed (on a dry matter basis) this relatively high-grade product stream, from which the various components can be further isolated relatively simply. The defibered product or the juice stream consists substantially of parenchyma, partly as intact cells, partly as disintegrated cell material. The color of the defibered product is typically green due to the presence of intact or broken chloroplasts, sometimes brown-green through browning during the fractionation. Macroscopically, it is a liquid. Microscopically, principally intact and disintegrated parenchyma cells and cell organelles such as chloroplasts are visible in this liquid.

The juice stream of such genetically modified plant materials according to the invention is further treated, for instance through screening, whereafter for instance the (recombinant) protein, peptides, amino acids, and other (recombinant) components in the juice are recovered by, for instance, coagulation through, for instance, acid and/or heat treatment. The juice stream can also be further treated through (ultra or membrane) filtration, drying, fermentation, or other methods known to those skilled in the art. Protein-rich or otherwise high-grade nutrients for human and animal consumption, but also pigments such as carotene (provitamin A), and specific recombinant products, can be recovered in this way from cytosol, also from that of leaf and/or stem parts.

The second product stream, the fiber fraction as provided by the invention, consists of the relatively hard tissues. These are typically the vascular bundles, the sclerenchyma and the epidermis. The cell content is absent from these tissues or is removed virtually completely during fractionation and washing. Consequently, fiber consists predominantly of cell wall components. Chloroplasts are virtually absent in a pure fiber preparation. The color of the washed fiber typically varies from white to yellow or light-brown. Sometimes, a light-green color may arise as a result of impregnation with chlorophyll during recovery. Macroscopically, the fiber fraction has a fiber structure chiefly due to the filamentary character of the vascular bundles. Microscopically, in addition to the filamentary structures of vascular bundles and sclerenchyma, typically, pieces of epidermis tissue are also recognizable, consisting of sheets one cell layer thick. The vascular bundles are built up from several cells including wood vessels and sieve tubes. Depending on the extent of fiberization, fibers consisting of one cell occur too, and further the residues of cell walls and (spiral, reticulate or ring-shaped) cell wall thickenings. Typical of the epidermis sheets is the presence of stomata and silicious teeth or hairs.

The fiber stream as contemplated by the invention consists substantially exclusively of a wet solid fiber stream (chiefly cellulose and hemicellulose) basically having no nutritive value since this fraction is not directly, and microbiologically only to a slight extent, digestible. However, the absence of digestibility makes it possible to use the fiber stream for non-food applications, this in contrast to, for instance, the press cake coming from the above-described traditional pressing methods where the press cake is in fact suitable only for fodder applications and would soon rot if it were not prepared into food and was eaten.

For example, the invention provides the use of a fiber fraction for the production of energy. The fiber fraction contains principally the carbohydrates cellulose and hemicellulose (composed principally of the elements C, H and O), which are eminently combustible and hence can be converted with a high efficiency to useful energy in, for instance, a combined heating and power station, and which may be expected to entail no or minor emission of harmful substances upon combustion. Processing plant material according to a method as contemplated by the invention, followed by the use of the resultant fiber fraction as fuel, will contribute to the reduction of the $CO_2$ emission, since what is involved here is a non-fossil fuel. Also, as such, the combustion of the fiber fraction will be cleaner for the environment, since the fiber fraction is hardly, if at all, contaminated with the salt residues (such as K, Na, Cl, P compounds) and protein residues (which incorporate S and N compounds) normally occurring in dry plants. These salt residues and protein residues, coming from the cytosol, have been separated, along with the juice stream, from the fiber fraction. Combustion of the fiber fraction (having therein principally C, H and O compounds which are converted by combustion to $H_2O$ and $CO_2$) will therefore entail a much lesser environmental impact than combustion of other plant material in which all these salt residues and protein residues are still present. Protein combustion contributes in particular to the emission of sulfur and nitrogen compounds such as sulfur and nitrogen oxides, and incombustible salt residues will contribute to the residual ash volume. Upon combustion of a fiber fraction according to the invention, the emission of, for instance, sulfur and nitrogen oxides, and the residual ash volume having therein the salt residues will be much smaller.

Since the fiber material is of organic origin, it is also applicable, for instance, as a peat substitute in, for instance, potting soil or in horticultural substrates.

In a preferred embodiment of the invention, the plant material is fiberized to such an extent that, for instance, the fiber material consists principally of elemental fibers, so that the so obtained fiber component or fiber stream is suitable, for instance, for further processing into cardboard and/or paper, or can be used as (natural) fiber in composites together with and in reinforcement of (artificial) resins.

Examples of vegetable material that can be treated with a method according to the invention are genetically modified (fodder) crops such as grasses (grains such as wheat, rye and maize included), lucerne, but also harvest residues of crops whose leaf and/or stem parts are normally not processed, such as potato or (sugar) beet tops which are generally left behind in the field upon harvesting. The high efficiency of a method according to the invention renders the processing of such vegetable materials profitable.

The invention further provides a method for separating components from vegetable material which has been harvested a relatively long time ago and has already, at least partly, dried out, or which can no longer be qualified as fresh and green, but has acquired a more woody and/or dry character for instance through maturation. Such material is not suitable for processing in a pressing method, but is now eminently processable, since the extent of turgor of the plant cell to be accessed is not important when a method according to the invention is used.

The invention provides a refiner, or an apparatus of comparable action, and the use of such an apparatus, for instance for separating components from vegetable material which does not (yet) exhibit any lignification, or exhibits only a minor extent of lignification, and in which parenchyma is present. This parenchyma with the cytosol present therein is the basis of the juice stream as contemplated by the invention. A refiner is generally used to break down wood chips into fibers for the purpose of making pulp for the production of paper and/or cardboard. The invention provides the processing of a genetically modified crop by means of a refiner. Refiners are generally not used for fresh and/or green material, since wood consists principally of dead or lignified tissue from which most parenchyma, with chloroplasts, has disappeared. Different types of refiners are known to those skilled in the art. There are, for instance, refiners with conical disks or with flat disks. The invention provides the use of both types, and/or equivalent apparatuses, for instance convex/concave type composite grinding disks, in a method provided by the invention.

The invention will now be further explained in the experimental section of the description, without limiting it.

Experimental Section

Experimentally, the invention was compared with the traditional technique. This was done using a lab(oratory) protocol and industrial equipment. On the basis of that, the nature of the fiber fraction can be assessed and the recoverability of content substances in the two methods can be compared. Results shown hereinbelow illustrate the difference in the recoverability of protein and other content substances.

Traditional Method

In the experiments on a laboratory scale, the traditional method of grinding and pressing was simulated by pulping material in a Tecator Homogenizer and squeezing the pulp using an adapted draw pressure bench of Lloyd Instruments. It was provided with a cup having a perforated bottom plate (surface 50 $cm^2$) in which 100 g of fresh pulp were pressed for 15 minutes at a pressure running up to 10 bar. The original material and the press juice were analyzed for nitrogen content, and the recoverability of protein was calculated as the amount of crude protein (amount of nitrogen multiplied by 6.25) in juice expressed as a percentage of the amount of crude protein in the original material.

On a larger scale, a hammer mill of the type Jenz A30 was employed to disintegrate grass and the thus obtained grass pulp was squeezed in a Vetter screw press with a compression ratio of 1:7.65 and a perforation of the cylinder wall of 0.7 mm. By passing plant material through the hammer mill a single time or several times, the material could be disintegrated to a greater or lesser extent.

New Method

In the experiments on a laboratory scale, the new method was simulated by fine-chopping fresh grass in a cutter, then mixing 30 g of fine-cut grass pieces with 400 ml of water, and fiberizing same in a blender for 10 minutes, screening the slurry from the blender on an 850 micron screen, and washing and drying the screened-off fiber fraction. The fiber was analyzed for contents of nitrogen, ash and cell walls and thus the composition of the defibered slurry was calculated. The fiber yield was determined as the amount of dry matter in the fiber fraction as a percentage of the amount of dry matter in the starting material. The recoverability of protein was calculated as the amount of crude protein in the defibered slurry expressed as a percentage of the amount of crude protein in the original material.

The new method was also tested with a Sprout-Waldron 12 inch pressure refiner, with grinding disks of the type D2A505. Refining or fiberizing fresh grass was done under atmospheric conditions at a disk distance of 0.04 mm, with addition of water to a consistency of about 2% dry matter. The fiber was then screened on a screen with 140 micron openings.

The new method was also tested on a semitechnical scale using a Sunds Disk Refiner type RO 20 FLUFF serial no. 3838, year of manufacture 1985, provided with grinding disks with a high or low resistance to throughput. With this refiner, inter alia the effect of disk type and disk distance on throughput and fiber composition was investigated.

Refining occurred under atmospheric conditions with chopped grass, with or without addition of water. The fiberization of potato tops was also tested.

The grass originated from both cultivated grassland and natural grounds and was processed in fresh, chopped form. Samples of the fiberized material were rinsed by hand and screened and analyzed for nitrogen and ash content. The recoverability of crude protein was calculated on the basis of an average fiber proportion of 33% of the grass dry matter.

The potato tops originated from starch potato plants during the full growth phase of the potato plant. The tops were pulled mechanically and were consequently crushed to some extent. The potato tops consisted of stems and leaves. The potato tops, without prior washing, were processed with the refiner while fresh, without addition of water. The fiberized material was squeezed out by hand.

Experimental Results

Press cake of grass (left) and grass fiber (right) stemming from perennial ryegrass (*Lolium perenne*).

In the press cake, the green color due to the presence of chloroplasts is conspicuous. Also, leaf fragments are recognizable by their size (cross section greater than 1 mm) and the characteristic ribs on the top of the leaf. The grass fiber is distinguished by the light color (virtually complete absence of chloropiasts), the filamentary structure and the small diameter of the individual fibers (in this case very much smaller than 1 mm). The distance between successive numbers is 1 cm.

FIG. 3

Suspension of grass fiber from perennial ryegrass (*Lolium perenne*).

Visible are fibrous structures (vascular bundles) of a diameter of a few tens of micrometers and epidermis sheets of a smallest diameter of up to a few hundreds of micrometers.

FIG. 4

Microscopic recording of epidermis in grass fiber originating from perennial ryegrass (*Lolium perenne*).

Characteristic is the presence of stomata in perennial ryegrass, concentrated in the epidermis of the top of the leaf. The more compact tissue on the side of the stomata is underlying sclerenchyma. The elongate epidermis cells have a cross section of about 20 micrometers.

FIG. 5

Microscopic recording of vascular bundles in grass fiber originating from perennial ryegrass (*Lolium perenne*).

Characteristic of vascular bundles are their being built up from several cells and the presence of vessels with reticulate thickenings. The diameter of the fiber in the middle of the figure is about 50 micrometers.

FIG. 6

Microscopic recording of parenchyma cells in the juice stream of defibered grass originating from perennial ryegrass (*Lolium perenne*). This juice stream belongs to the fiber fraction of FIGS. 1 and 2.

Characteristic of parenchyma cells in grass leaves is the abundant presence of chloroplasts. Some parenchyma cells, however, have been broken during fractionation: only the cell wall is still visible, the chloroplasts occur in isolation in the surrounding fluid. The size of these parenchymal cells is about 20*40 micrometers. The fraction shown in this figure was diluted prior to being photographed to bring out the relatively large amount of parenchyma cells in the juice stream according to the invention.

FIG. 7

Microscopic recording of parenchyma cells in press juice from grass originating from perennial ryegrass (*Lolium perenne*).

Figure 1:
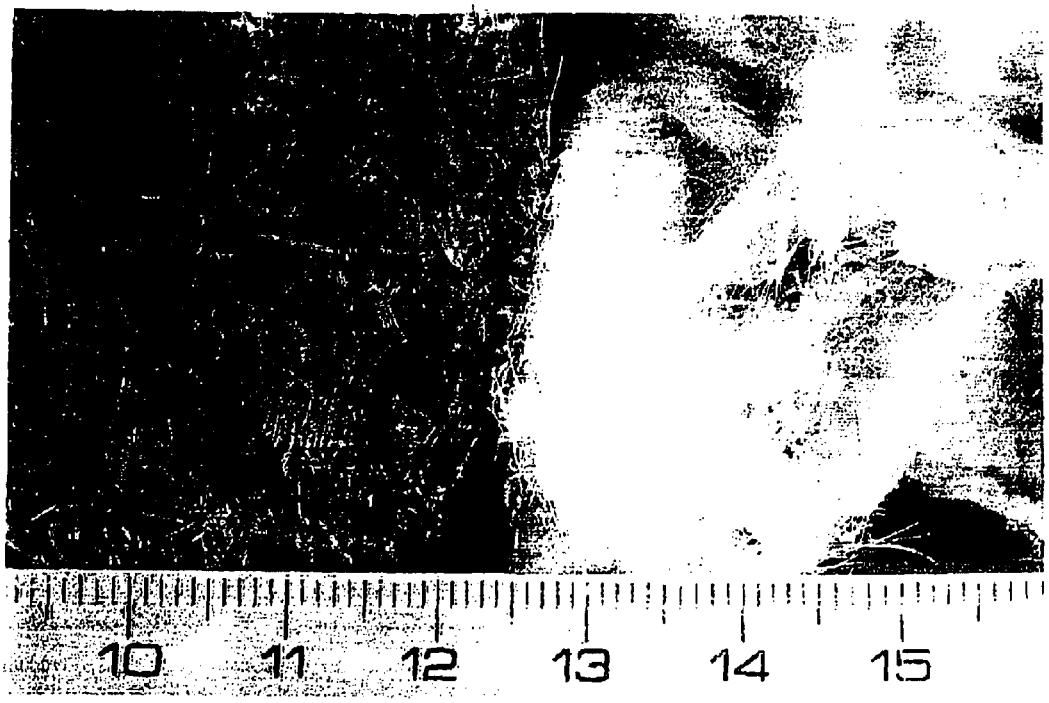
FIG. 1 and FIG. 2 (detail)
Figure 2:
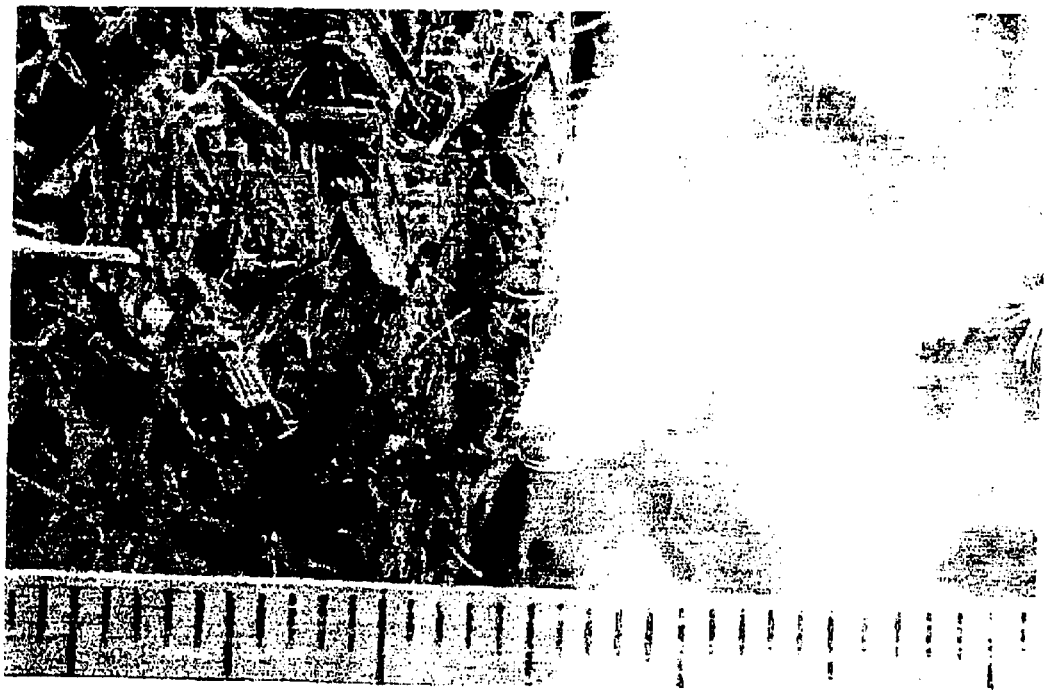
Figure 3:
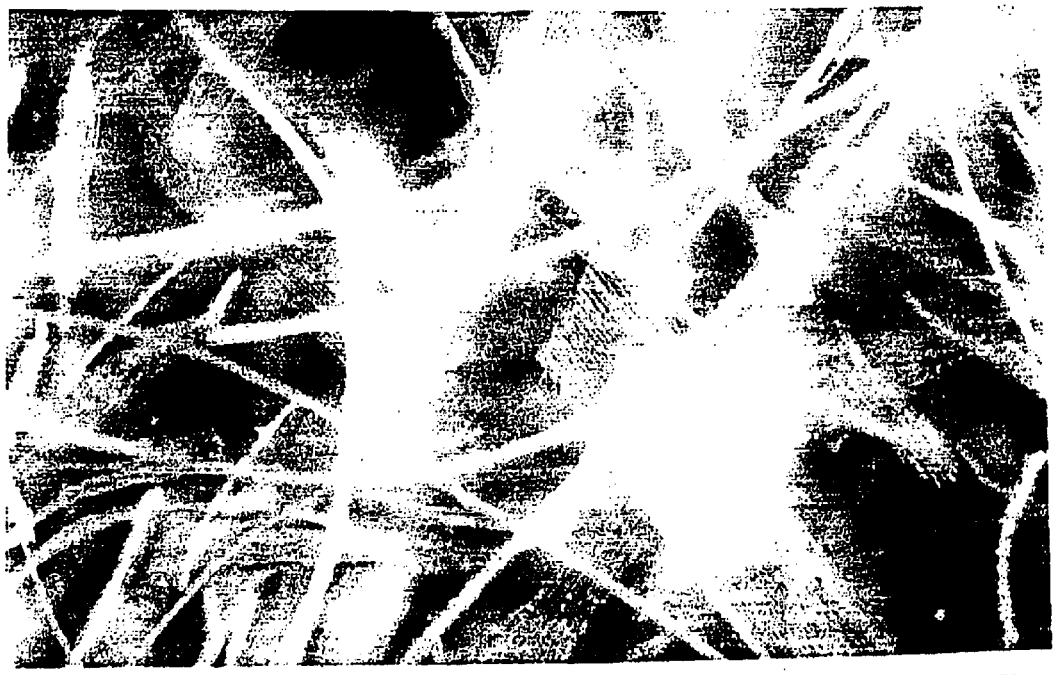
Figure 4:
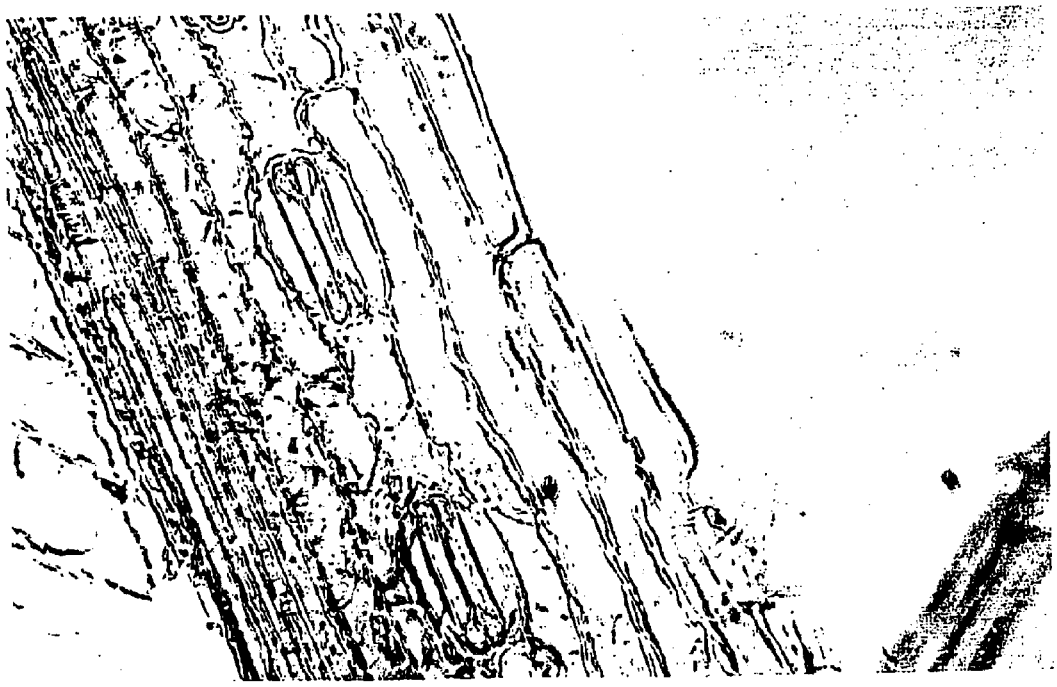
Figure 5:
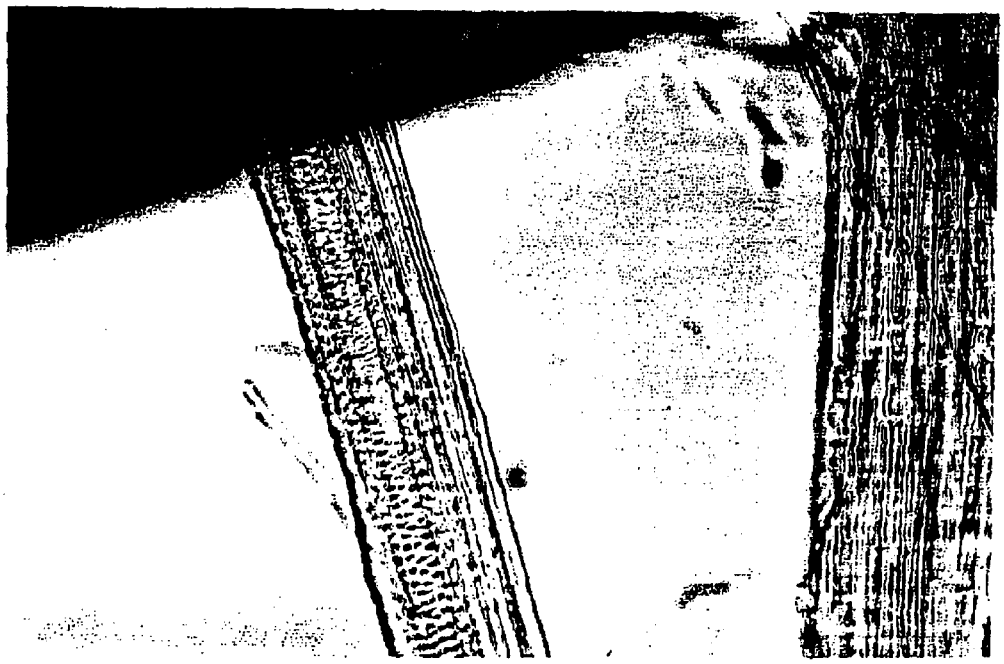
Figure 6:
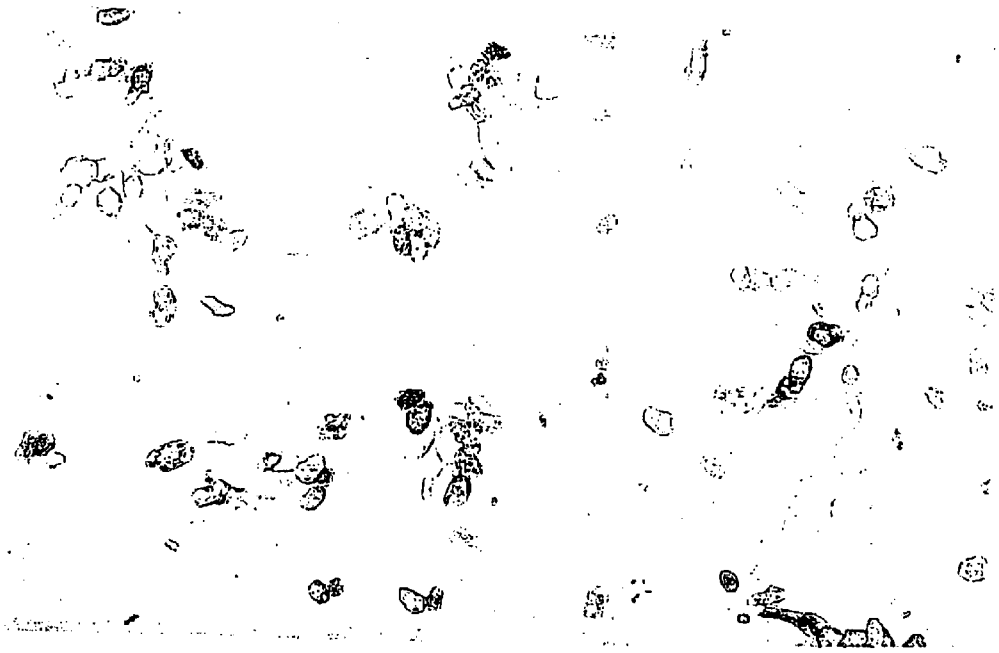
Figure 7:
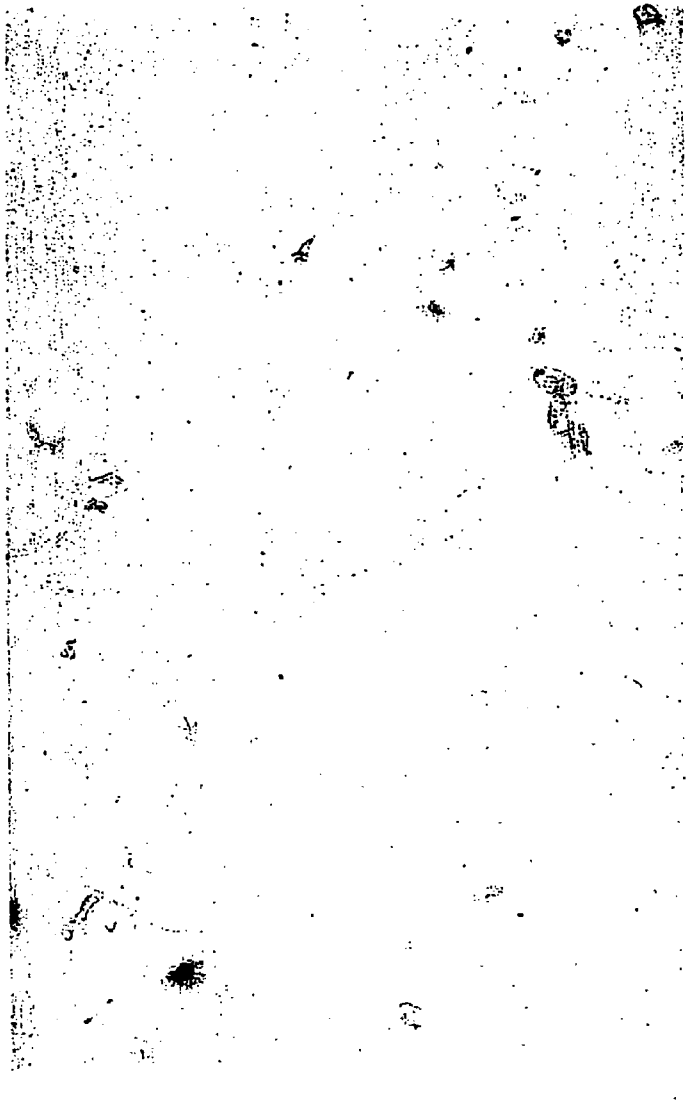

This press juice belongs to the press cake of FIGS. 1 and 2. The fraction shown in this figure was concentrated prior to being photographed to bring out the relatively small amount of parenchyma cells in the press juice.

FIG. 8

Process diagram for fiberizing or refining grass.

FIG. 9

Process diagram for fiberizing or refining grass.

FIG. 10

Process diagram for fiberizing or refining grass.

FIBERIZATION

TABLE 1

Fiber composition and fiber yield of cultivated grasses, by species and variety, on average during the season, and of a few other crops.

| Species/variety | Nitrogen content (g/kg dm**) | % of dry Ash content (g/kg dm) | Cel wall content (g/kg dm) | Fiber yield matter in raw material |
|---|---|---|---|---|
| Grasses | | | | |
| *Lolium perenne* 4n Vr.* | 4.0 | 50.6 | 867 | 28 |
| *Lolium perenne* 2n Vr. | 4.3 | 43.5 | 865 | 34 |
| *Lolium perenne* 4n Lt. | 4.5 | 41.1 | 879 | 29 |
| *Lolium perenne* 2n Lt. | 5.4 | 34.7 | 857 | 29 |
| *Lolium multiflorum* 4n | 3.8 | 47.4 | 877 | 24 |
| *Lolium multiflorum* 2n | 4.4 | 36.6 | 880 | 27 |
| *Phleum pratense* | 4.3 | 39.8 | 862 | 30 |
| *Festuca arundinacea* | 4.4 | 36.7 | 867 | 29 |
| *Dactylis glomerata* | 5.1 | 42.0 | 873 | 32 |
| *Festuca pratensis* | 4.5 | 44.2 | 872 | 32 |
| Other plant materials | | | | |
| Lucerne | 5.7 | 18.9 | 824 | 28 |
| Potato tops young | 4.2 | 26.1 | 836 | 16 |
| Potato tops old | 3.7 | 50.7 | 714 | 21 |
| Pea tops | 4.8 | 25.7 | 832 | 29 |
| Beet tops | 12.0 | 79.7 | 680 | 9 |

*) 4n = tetraploid; 2n = diploid;
Vr. = early-flowering; Lt. = late-flowering
**) dm: dry matter Fiberizing vegetable biomass yields a fiber fraction which, depending on the nature of the material, can vary from less than 10% to more than 30% of the dry matter. The exact number is also dependent on the mesh of the screen with which the fiber is separated and the intensity of washing. The fiber fraction in the case of *Lolium perenne* typically consists for more than 80% of cell wall material and has a nitrogen content mostly lower than 6–8 g per kg of dry matter and an ash content mostly lower than 50–100 g per kg of dry matter.

TABLE 2

Composition of fiber

| | refiner | lab protocol |
|---|---|---|
| Ash (g/kg d.m.) | 22.3 | 26.0 |
| Nitrogen (g/kg d.m.) | 5.3 | 4.4 |
| Cell walls (g/kg d.m.) | 808 | 792 |

The composition of the fiber fraction is comparable for the experiments with the refiner and the experiments according to the lab protocol.

DEFIBRATION

TABLE 3

Composition of grass and of the defibered grass slurry.

| | Grass | Defibered slurry refiner | Defibered slurry lab protocol |
|---|---|---|---|
| Ash (g/kg d.m.) | 92.6 | 136 | 139 |
| Nitrogen (g/kg d.m.) | 31.0 | 47.4 | 48.7 |
| Cell walls (g/kg d.m.) | 544 | 375 | 438 |

In addition to the cell content constituents (such as protein), the defibered slurry also contains a part of the cell walls from the plant material. These are substantially the cell walls from the soft parenchymal tissue which disintegrate upon fiberization and subsequently, in defibration, pass the screen as finely dispersed material. The amount present in the defibered slurry is partly dependent on the diameter of the screen orifices.

TABLE 4

Recoverability of crude protein from cultivated grasses, by species and variety, on average during the season, and a few other plant materials, upon grinding + pressing and upon defibration.

| Species/variety | Grinding + pressing (%) | Defibration (%) |
|---|---|---|
| Grasses | | |
| *Lolium perenne* 4n Vr. | 30 | 95 |
| *Lolium perenne* 2n Vr. | 23 | 94 |
| *Lolium perenne* 4n Lt. | 22 | 95 |
| *Lolium perenne* 2n Lt. | 16 | 94 |
| *Lolium multiflorum* 4n | 41 | 96 |
| *Lolium multiflorum* 2n | 35 | 95 |
| *Phleum pratense* | 11 | 94 |
| *Festuca arundinacea* | 21 | 94 |
| *Dactylis glomerata* | 31 | 93 |
| *Festuca pratensis* | 17 | 94 |
| Other materials | | |
| Lucerne | 52 | 95 |
| Potato tops young | 51 | 98 |
| Potato tops old | 42 | 95 |
| Pea tops | 16 | 95 |
| Beet tops | 24 | 95 |

Defibration yields a slurry mostly containing more than 70%, and preferably more than 80% or 90%, of all crude protein from the vegetable material. This protein can be recovered from it by centrifugation, which may or may not be preceded by heat coagulation.

In the traditional method of fractionation, the recoverability of crude protein is mostly less than 50%.

TABLE 5

Comparison of protein recoverability from grass upon repeated passage through hammer mill followed by squeezing in a screw press, and upon fiberization according to the invention.

| Hammer mill + screw press Passages through hammer mill | Protein recoverability (%) |
|---|---|
| 1x | 28 |
| 2x | 30 |
| 4x | 35 |
| 8x | 43 |
| Fiberization according to the invention | 93–96 |

Even upon repeated disintegration of grass in a hammer mill followed by squeezing in a screw press, the protein recoverability was found to be less than half of the protein recoverability measured upon fiberization of grass.

Process diagrams for refining underground parts of crops such as tubers and roots.

Washed sugar beets are metered in pre-chopped or pre-cut form into a refiner. During this process step, the tuberous tissue is fiberized into a pulp. After the fiberization step, the fiber fraction is separated from the juice stream, for instance through screening, filtration or centrifugation, and the solid fraction is optionally washed with water to recover the components which can still be dissolved therein. The liquid fraction or juice stream can be further processed after centrifugation, to recover the sugars in the manner conventional in the sugar industry (carbonation, concentration, crystallization, centrifugation, etc.). By the use of the method according to the invention, the conventional diffusion step is not necessary anymore. Not 1100 liters of water are recovered, but an already highly concentrated juice stream is the result. Besides a direct saving of cost as a result of the elimination of the diffusion step, the concentration of the sugar in the serum or juice stream will be higher than that in the stream of the diffusion step. Moreover, the elimination of the diffusion step will mean a saving of the total amount of water required, with an inherent saving of evaporation and drying costs. By following a method according to the invention, the sugar loss (normally about 2%) will be greatly reduced in that the total amount of sugar present in the beet remains behind in the serum. Also, owing to the fiberization, the fiber fraction of the sugar beet is better digestible than the conventional pulp, when used as ingredient of fodders.

The results of the tests with the Sunds Disk Refiner are summarized in Table 6.

Choice of plate type and disk distance determine the extent of fiberization but determine protein recoverability only to a slight extent. A high throughput was possible in combination with a high protein recoverability (in this case >85%) both with protein-rich cultivated grass and with protein-low natural grass.

Potato tops are well processable with the refiner. In the fiber fraction the content of woody fibers is relatively high because the original potato tops consisted not only of leaf tissue but also of stem tissue. The high ash content in the fibers of the potato tops was caused to an important extent by the high sand content in the tops due to not washing the raw material.

TABLE 6

Fiber composition and protein recoverability upon accessing grass and potato tops on a semitechnical scale using a Sunds Disk Refiner.

| | composition raw material | | | disk | | | composition fiber | | |
|---|---|---|---|---|---|---|---|---|---|
| Raw material | d.m. (g/kg frash) | ash (g/kg d.m.) | N (g/kg d.m.) | Plate resistance | disk distance mm | through-put (kg d.m./hour) | ash (g/kg d.m.) | N (g/kg dm) | protein recoverability (%) |
| cultivat. grass | 154 | 91 | 19.3 | high | 0.4 | — | 13 | 5 | 91 |
| cultivat. grass | 142 | 183 | 36.1 | high | 0.10 | 39 | 31 | 14 | 87 |
| cultivat. grass | " | " | " | high | 0.50 | 55 | 27 | 15 | 86 |
| cultivat. grass | " | " | " | high | 1.00 | 104 | 38 | 15 | 86 |
| cultivat. grass | " | " | " | low | 0.05 | 157 | 49 | 14 | 87 |
| cultivat. grass | " | " | " | low | 0.10 | 135 | 41 | 14 | 87 |
| cultivat. grass | " | " | " | low | 0.50 | 139 | 54 | 15 | 86 |
| cultivat. grass | " | " | " | low | 1.00 | 211 | 82 | 20 | 82 |
| natural grass | 215 | 138 | 12.1 | low | 0.10 | — | 41 | 6 | 84 |
| potato tops | 104 | 342 | 23.5 | high | 0.20 | — | 473 | 15.2 | — |
| " | 119 | 344 | 27.0 | low | 0.20 | — | 374 | 19.0 | — |

Process diagrams for refining crops having chiefly leaf and/or stein parts, such as grass.

Pretreatment

The appended process diagrams (see FIGS. 8 to 10) start from the supply of chopped grass as is also conventional in the processing of grass and lucerne in herbage dryers. Normally, the chopping length is in the order of magnitude of a few centimeters, but it can also be longer or shorter. For the refiner test, fresh grass was pre-comminuted in a Pierret guillotine cutter to 6 mm particle length, in other words, very short. Presumably, such a short length is not requisite; refining or fiberizing pressed grass (of a particle length of presumably a few centimeters) did not present any problems.

Washing

A washing step will probably be necessary in practice to remove sand and thereby reduce equipment wear and enable a cleaner product yield. This washing step, however, may be skipped if sand and other contaminants are not present.

Sulfite Addition

Addition of sulfite may be necessary, but need not be so, to prevent undesirable complexing between proteins and polyphenols. On the basis of past experiences regarding the processing of grass sap, it is known that such complex formation reduces the nutritive values of grass proteins. The circumstances during refining, however, may be different. A rapid temperature rise during refining may instantly stop enzymatic activity (blanching effect) and inhibit formation of polyphenols.

Figure 8:
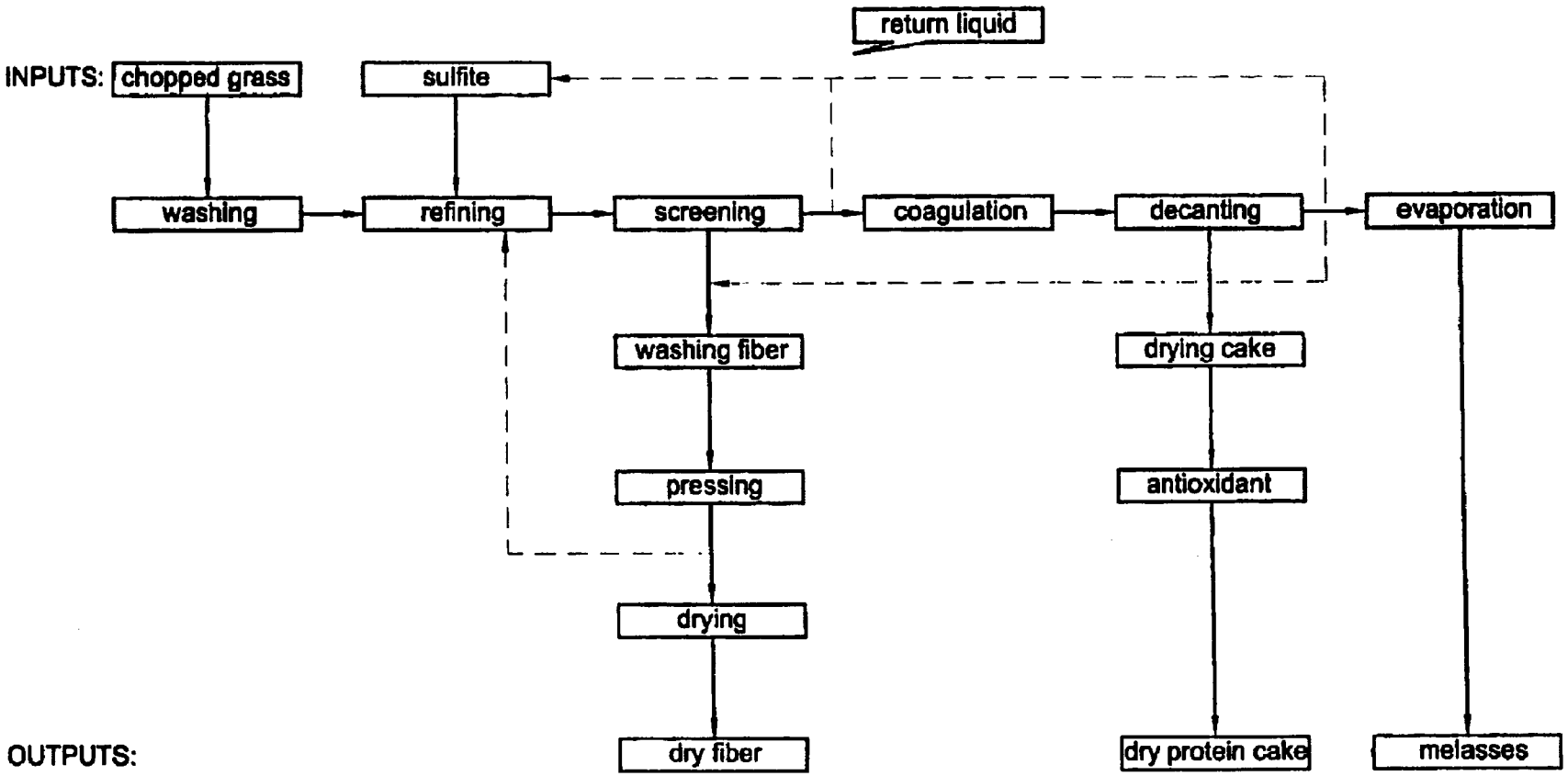

Refining: Basic Diagram (FIG. 8)

Refining grass is in principle possible with and without liquid addition during refining. In a first test, with fresh grass (15% dry matter), the process did not proceed readily without generous admixture of water to a dry matter percentage of about 2%. The necessity of liquid addition is probably partly dependent on the type of refiner and the nature of the grass (fibrousness). Squeezed grass (26% dry matter) could be refined without water addition. If, and if so, how much water is admixed, has consequences for the temperature rise during refining, and therefore for the extent of protein denaturation and hence for the subsequent steps in the process.

The basic diagram includes, after refining, the process steps: screening out the fiber, heat coagulating the refiner liquid followed by separation of the protein cake by means of a decanter and evaporation of the deproteinized liquid. Two extreme variants of this basic diagram are conceivable: one with a minimal addition of liquid during refining and one with ample addition of liquid. The basic diagram is then changed to variant A (FIG. 9) and variant B (FIG. 10), respectively.

Figure 9:
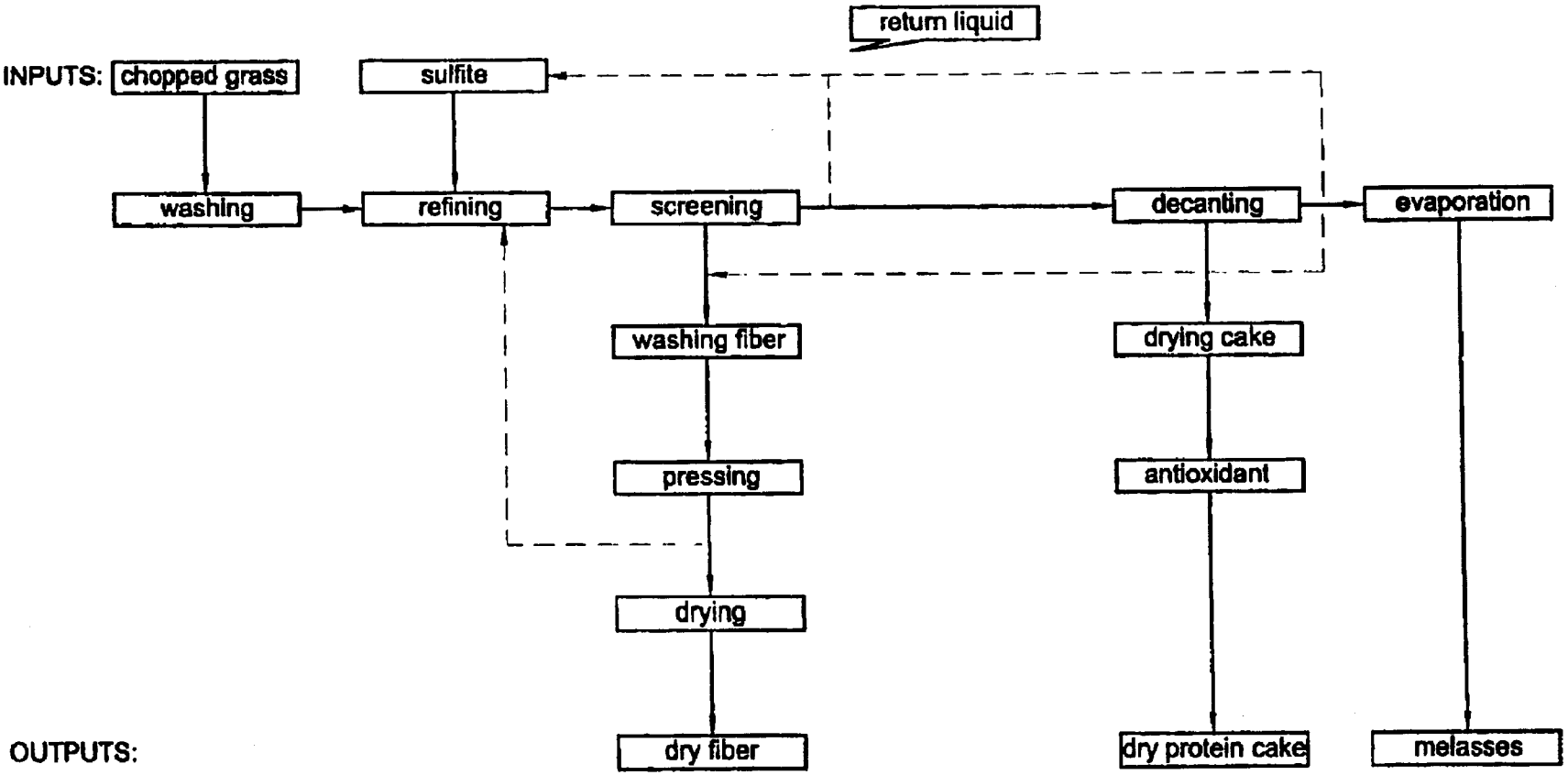

Refining: Variant A (FIG. 9)

Upon minimal addition of return liquid, possibly a substantial temperature rise will occur during refining: in the test with squeezed grass to above 70° C. Protein coagulation and pasteurization will then occur already during refining and possibly a separate coagulation step may then be skipped. In that case, the process diagram is simplified to refining—screening—decanting—evaporation: see variant A on basic diagram.

Figure 10:
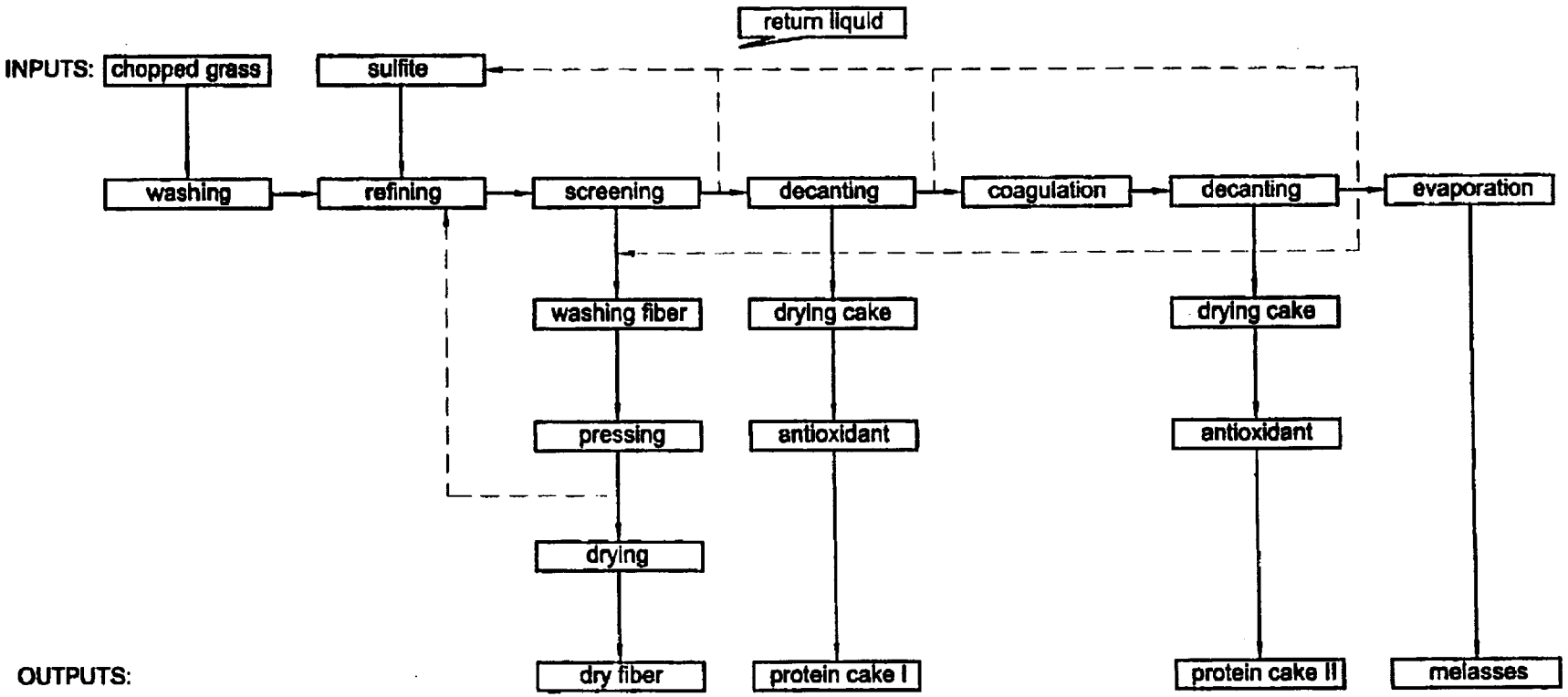

Refining: Variant B (FIG. 10)

Variant B: In case of ample addition of return liquid, the temperature rise during refining can remain limited: in the test with fresh grass to about 35° C. As a result, presumably, a part of the protein can remain in solution. In that case, after refining, two alternative routes are conceivable. The simplest one is, after screening out the fiber, to heat-coagulate the liquid and decant. In that case, one protein cake is formed and a deproteinized liquid that can be evaporated (see the basic diagram). A more complex route (variant B) comprises, after screening out the fiber, initial decanting whereby a crude protein cake is obtained (crude, i.e. with admixture of finely divided parenchymal cell walls that pass the screen), followed by heat-coagulation and decanting again. In this second decanting step, a purer protein cake is obtained.

Screening Out the Fibers

For the purpose of screening out the fibers, centriscreens can be employed, as known to those skilled in the art for separating potato fiber. In the test, an inclined screen was used, having stretched onto it a wire gauze with openings of 140*140 microns. On a lab scale, a screen with a hole diameter of 850 and 250 microns was used. Experiences with it are that most fibers can be separated on a relatively coarse screen. The finer fiber fraction can be added to the total fiber fraction or, via enzymatic deliquescence, to the molasses, concentrate or juice stream.

Washing and Drying of Fiber

The fiber that is separated by screening may be contaminated with dissolved and suspended substance. Accordingly, washing with deproteinized return liquid is then necessary, followed by moisture removal through pressing/centrifugation and drying.

Drying Protein Cake

The protein-rich cake which is separated through decanting can be dried in the same manner as is known to those skilled in the art for, for instance, potato protein. In case of the presence of a relatively high lipid fraction, addition of an antioxidant product has an improving effect.

Evaporation of Deproteinized Liquid

The deproteinized liquid can he evaporated to form a sugar-rich syrup.

Extended Procedure

The basic diagram can be expanded to include processes for the purpose of further refining the crude protein cake. One possible addition is enzymatic deliquescence of the parenchymal cell walls in the crude protein cake. The sugars which this yields can, for instance, be added to the molasses, concentrate or juice stream.

We claim:

1. A method for separating virtually completely cytosolic and parenchyma components from cell walls and fibrous components of vegetable material, said method comprising fiberizing said-vegetable material, by means of a pulp or paper mill refiner, to substantially open all cell walls and dissociate virtually completely all cytosolic and parenchyma materials from cells walls and fibrous materials; and subsequently separating said fiberized and dissociated material into a fiber fraction, which comprises virtually completely all dissociated fibrous materials and cell walls, and a juice stream, which comprises virtually completely all dissociated cytosolic materials and parenchyrna.

2. A method according to claim 1, wherein the juice stream comprises chloroplasts.

3. A method according to claim 1, wherein the fiber fraction is separated from the juice stream by screening, centrifugation, processing by cyclone, hydrocyclone, centriscreening, decanting, sedimentation, or combinations thereof.

4. A method according to claim 1, wherein the vegetable material originates from a genetically modified plant.

5. A method according to claim 1, wherein the vegetable material comprises parts of a plant which grow underground.

6. A method according to claim 1, wherein the vegetable material originates from a cultivated crop.

7. A method according to claim 1, further comprising recovering or purifying at least one nutritional substance from said juice stream.

8. A method according to claim 7, wherein said nutritional substance is a carbohydrate.

9. A method according to claim 1, further comprising recovering or purifying at least one recombinant product from said juice steam.

* * * * *

UNITED STATES PATENT AND TRADEMARK OFFICE

CERTIFICATE OF CORRECTION

PATENT NO. : 6,740,342 B1
DATED : July 12, 2004
INVENTOR(S) : Hulst et al.

It is certified that error appears in the above-identified patent and that said Letters Patent is hereby corrected as shown below:

Column 5,
Line 63, now reads "(gulp)" should read -- (pulp) --;

Column 8,
Line 21, now reads "jointly in the fiber fraction)" should read -- (jointly in the fiber fraction) --;
Line 38, now read "MDF/FHDF" should read -- MDF/HDF --;

Column 9,
Line 5, now reads "slurr" should read -- slurry --;
Line 6, now reads "is envisaged" should read -- as envisaged --;
Line 35, now reads "de nouo" should read -- de novo --;

Column 10,
Line 17, now reads "jointly the fiber fraction)" should read -- (jointly the fiber fraction) --;

Column 18,
Line 62, now reads "stein" should read -- stem --;

Column 20,
Line 44, now reads "parenchyrna" should read -- parenchyma --.

Signed and Sealed this

First Day of February, 2005

JON W. DUDAS
*Director of the United States Patent and Trademark Office*